US005997199A

United States Patent [19]

Sheng et al.

[11] Patent Number: 5,997,199

[45] Date of Patent: Dec. 7, 1999

[54] PAPER FEEDING MODULE OF A COLOR PICTURE PRINTER

[75] Inventors: Gary Sheng, Taoyuan; Hans Chang, Taichung Hsien, both of Taiwan

[73] Assignee: Mustek Systems Inc., Taiwan, China

[21] Appl. No.: 09/148,051

[22] Filed: Sep. 3, 1998

[51] Int. Cl.[6] ..... B41J 13/02

[52] U.S. Cl. ..... 400/636; 400/636.3; 400/637; 400/639

[58] Field of Search ..... 400/636, 636.1, 400/636.2, 636.3, 637, 637.1, 638, 639; 271/228, 274

[56] References Cited

U.S. PATENT DOCUMENTS

| | | | |
|---|---|---|---|
| 2,005,450 | 6/1935 | Bower | 400/636.3 X |
| 4,522,520 | 6/1985 | Takenoya et al. | 400/636.1 |
| 4,611,939 | 9/1986 | Fujiwara | 400/637 |
| 4,883,375 | 11/1989 | Karube et al. | 400/638 X |
| 5,129,749 | 7/1992 | Sato | 400/639 |
| 5,182,861 | 2/1993 | Suzuki et al. | 400/636.1 X |
| 5,594,486 | 1/1997 | Kiyohara | 400/636.2 X |
| 5,645,361 | 7/1997 | Mitsushima et al. | 400/636 |

*Primary Examiner*—Ren Yan
*Assistant Examiner*—Minh Chau
*Attorney, Agent, or Firm*—Winston Hsu

[57] ABSTRACT

The present invention relates to a paper feeding module of a color picture printer for driving a picture back and forth through a printing module of the printer for printing. The printer comprises a housing. The printing module is installed inside the housing for printing the paper. The paper feeding module comprises a first roller, a second roller and an elastic device. The first roller is horizontally installed inside the housing and is rotatable. The second roller comprises at least two cylindrical sleeves mounted onto a revolving axle for clamping the paper with the first roller. The second roller is installed in parallel with, in contact with and above the first roller inside the housing, is moveable in a vertical direction, and is rotatable. When the first and second rollers are rotated in opposite directions, the paper is clamped and driven between the first roller and the sleeves of the second roller. The elastic device is installed between the second roller and the housing and comprises a plurality of elastic arms in contact with two ends of the revolving axle of the second roller and the portions of the revolving axle between each adjacent pair of sleeves. The pads uniformly depress the revolving axle of the second roller so that each sleeve of the second roller is maintained in close and even contact with the first roller so as to clamp the paper.

5 Claims, 3 Drawing Sheets

PAPER FEEDING MODULE OF A COLOR PICTURE PRINTER

BACKGROUND OF THE INVENTION

1. Field of the Invention

The invention relates to a color picture printer, and more particularly, to a paper feeding module of a color picture printer.

2. Description of the Prior Art

A paper feeding module of a color picture printer comprises two rollers for clamping and driving a paper. The paper feeding module must securely clamp the paper along a front-and-rear direction for precise printing of a color picture. When driving the paper, there must be no unwanted displacement of the paper within the paper feeding module. This helps to prevent degradation of printing quality.

Please refer to FIG. 1. FIG. 1 is a perspective view of a paper feeding module 10 of a prior art color picture printer. The paper feeding module 10 comprises a first roller 12 horizontally and rotatably installed inside the housing 11, and a second roller 14 movable along a vertical direction and rotatably installed in contact and in parallel with the first roller 12. The second roller 14 comprises a revolving axle 16 and two cylindrical sleeves 18 mounted on the revolving axle 16 to clamp the paper with the first roller 12. As the first roller 12 and the second roller 14 are rotated in opposite directions, the paper is driven between the first roller 12 and the sleeves 18 of the second roller 14.

Please refer to FIG. 2. FIG. 2 is a perspective view of the paper feeding module 10 with force exerted on its two ends 20. The contact force between the first and second rollers 12, 14 of the prior art color picture printer is generated by imposing force at two ends 20 of the second roller 14. This force is unevenly distributed throughout the revolving axle 16 with the greatest force concentrated at the two ends 20. This causes the bar to bend leading to uneven contact of the first and second rollers 12, 14, unbalanced forward driving force of the paper, and subsequent potential sliding of the paper and degradation of printing quality.

SUMMARY OF THE INVENTION

It is therefore a primary objective of the present invention to provide a paper feeding module to solve the above mentioned problems.

In a preferred embodiment, the present invention provides a paper feeding module of a color picture printer that drives a paper back and forth for printing, the printer comprising a housing with the printing module installed inside the housing; the printing module for printing the paper, the paper feeding module comprising:

a first roller horizontally oriented and rotatably installed inside the housing;

a second roller comprising at least two cylindrical sleeves mounted on a revolving axle for clamping the paper with the first roller wherein the second roller is moveable in a vertical direction above the first roller inside the housing, is rotatable and installed in parallel and in contact with the first roller, and wherein when the first and second rollers are rotated in opposite directions, the paper is clamped and driven between the first roller and the sleeves of the second roller; and an elastic device installed between the second roller and the housing comprising a plurality of elastic arms in contact with two ends of the revolving axle of the second roller and the portions of the revolving axle between each adjacent pair of sleeves for uniformly depressing the revolving axle of the second roller so that each sleeve of the second roller is in even and tight contact with the first roller so as to clamp the paper.

It is an advantage of the present invention that the elastic arms of the paper feeding module depress the revolving axle thus bringing the first and second rollers in tight and even contact and enabling secure clamping of the paper. There is no bending of the revolving axle of the second roller and therefore no unwanted displacement of the paper.

These and other objectives of the present invention will no doubt become obvious to those of ordinary skill in the art after reading the following detailed description of the referred embodiment which is illustrated in he various figures and drawings.

DETAILED DESCRIPTION OF THE PREFERRED EMBODIMENT

Figure 1:
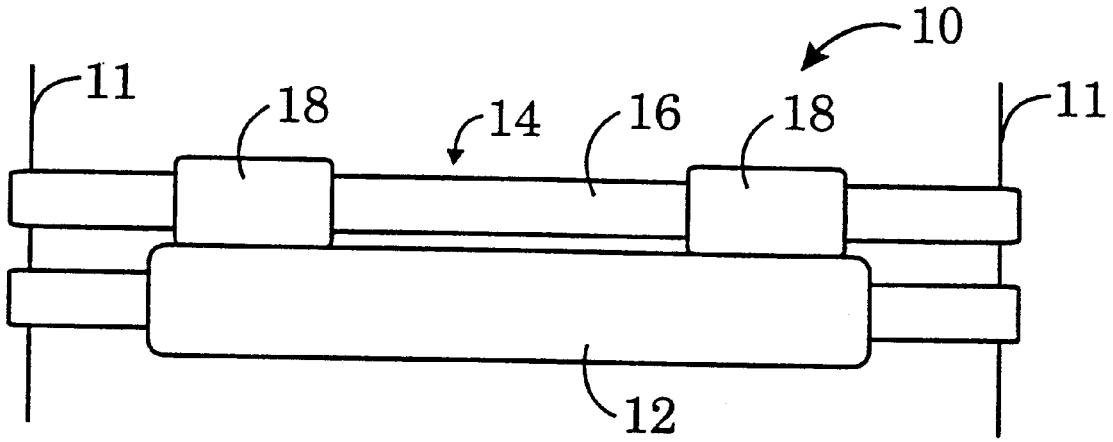
FIG. 1 Prior Art
FIG. 1 is a perspective view of a paper feeding module of a prior art color picture printer.
Figure 2:
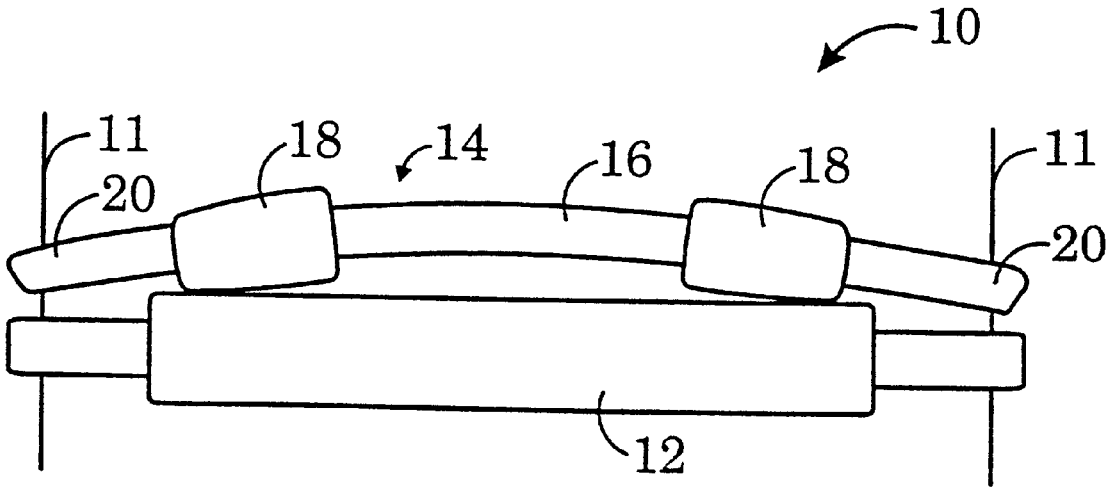
FIG. 2 Prior Art
FIG. 2 is a perspective view of the paper feeding module with force exerted on its two ends.
Figure 3:
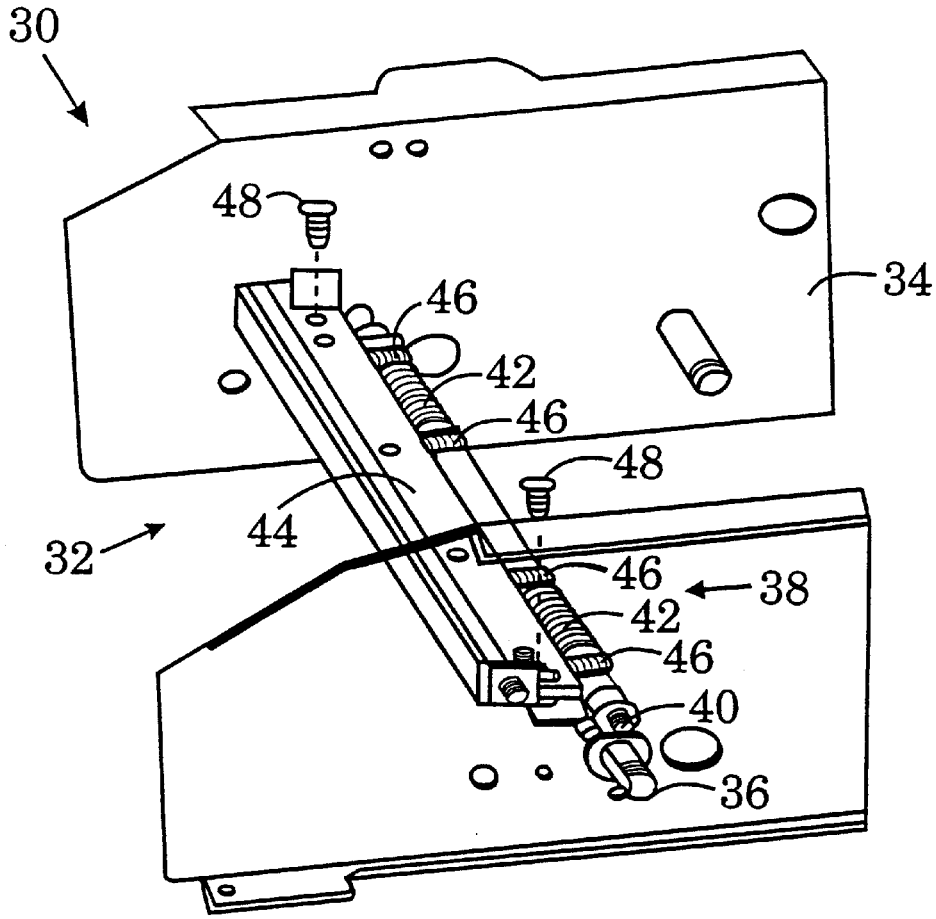
FIG. 3 is a perspective view of a paper feeding module of a color picture printer according to the present invention.
Figure 4:
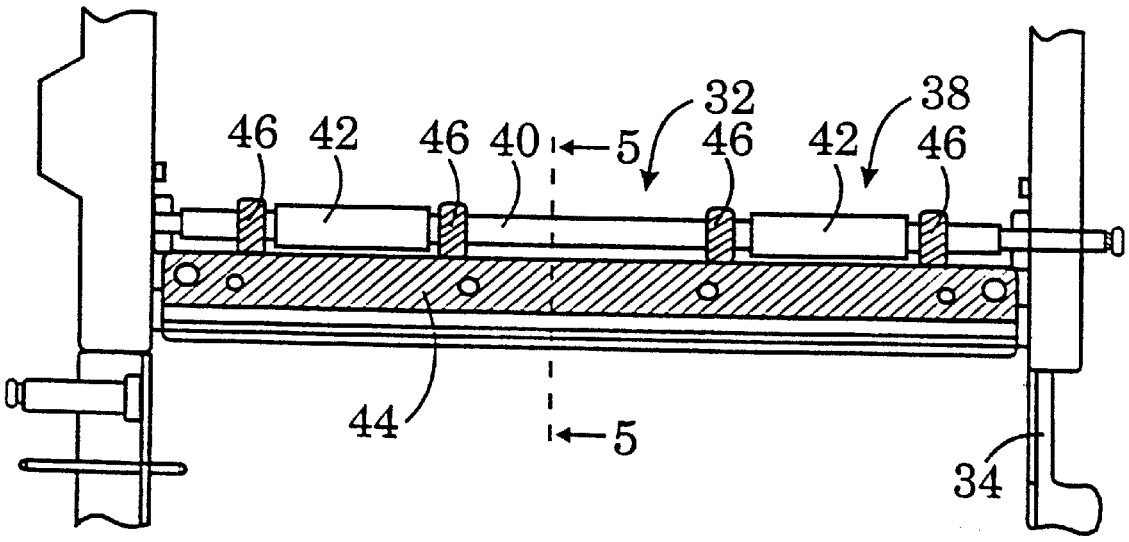
FIG. 4 is a top view of the paper feeding module in FIG. 3.

Please refer to FIGS. 3 and 4. FIG. 3 is a perspective view of a paper feeding module 32 of a color picture printer 30 according to the present invention. FIG. 4 is a top view of the paper feeding module 32. The color picture printer 30 comprises a housing 34, and a paper feeding module 32 installed inside the housing 34 for feeding a paper for printing. The paper feeding module 32 comprises a rotatable first roller 36 horizontally installed inside the housing 34, and a rotatable second roller 38 movable along a vertical direction and installed in parallel and in contact with an upper side of the first roller 36. The second roller 38 comprises two cylindrical sleeves 42 mounted on a revolving axle 40 for clamping the paper with the first roller 36. As the first roller 36 and the second roller 38 are rotated in opposite directions, the paper is clamped and driven between the first roller 36 and the sleeves 42 of the second roller 38.

The paper feeding module 32 further comprises an elastic plate 44 installed between the second roller 38 and the housing 34. Four elastic arms 46 are installed on the elastic plate 44 and at both sides of each sleeve 42 of the second roller 38 in pairs for evenly depressing the revolving axle 40 of the second roller 38. During printing, the elastic arms 46 keep the sleeves 42 of the second roller 38 and the first roller 36 in close and even contact thereby firmly clamping and securely driving the paper.

Figure 5:
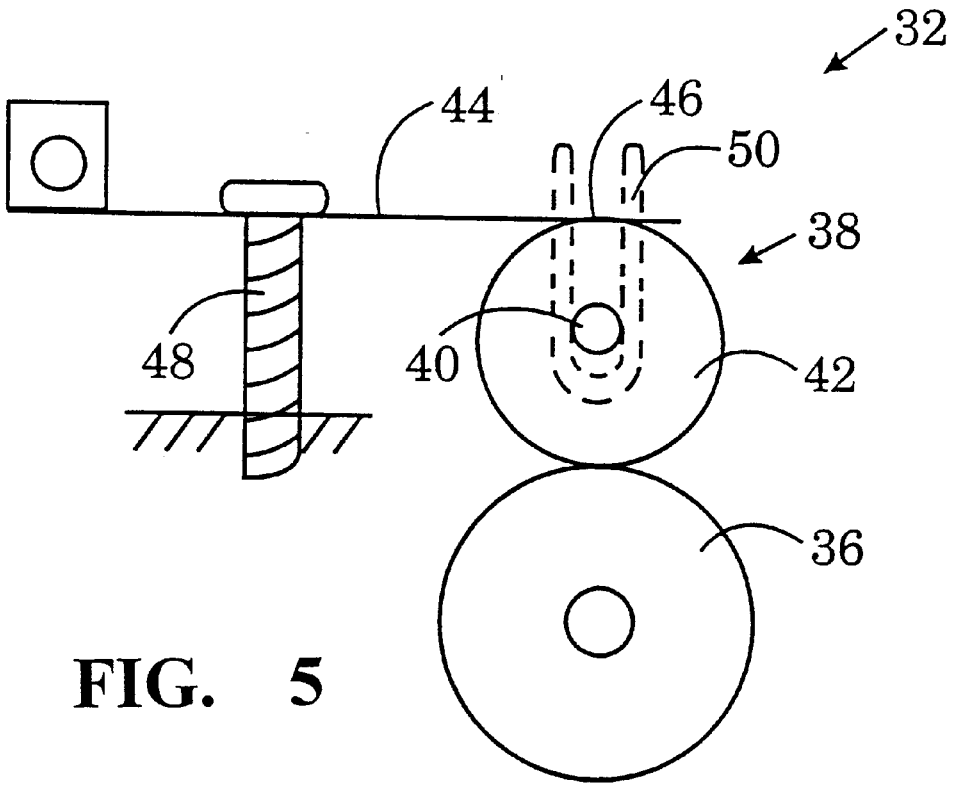
FIG. 5 is a sectional view along line 5—5 of the paper feeding module shown in FIG. 4.
Figure 6:
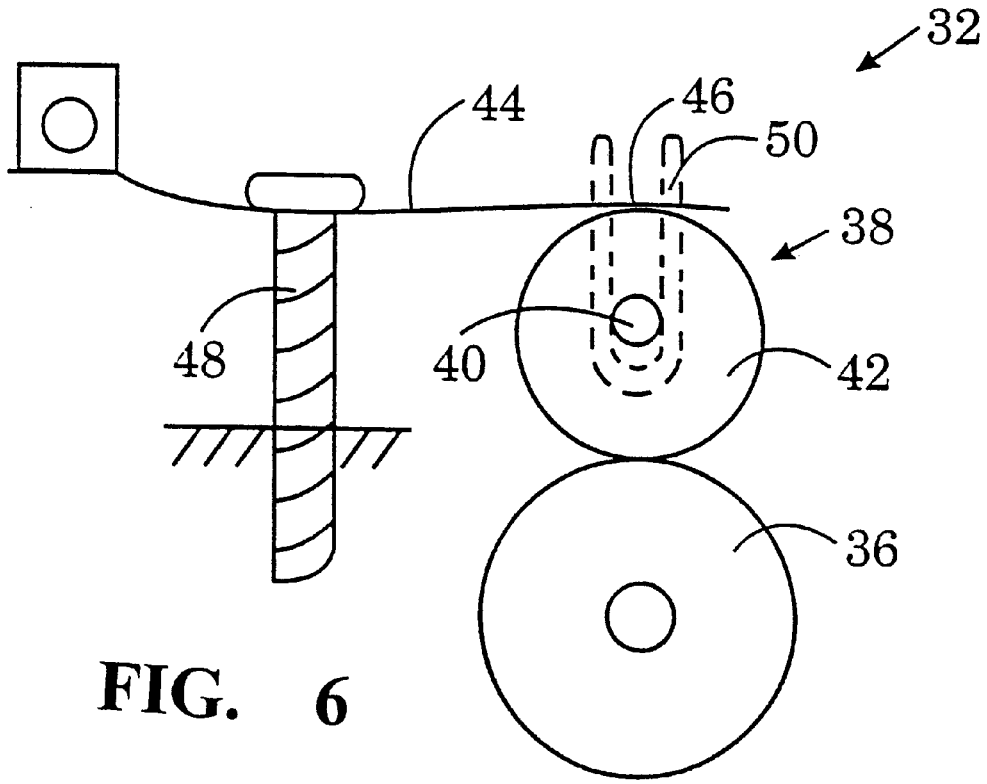
FIG. 6 is a sectional view of the paper feeding module when experiencing pressure from the elastic plate shown in FIG. 3.

Please refer to FIGS. 5 and 6. FIG. 5 is a sectional view along line 5—5 of the paper feeding module 32. FIG. 6 is a sectional view of the paper feeding module 32 when experiencing pressure from the elastic plate 44. The housing 34 further comprises two vertical slots 50 installed above the two ends of the first roller 36. The two ends of the revolving axle 40 of the second roller 38 are installed inside the two vertical slots 50 and are moveable along a vertical direction. The elastic plate 44 further comprises two adjustable screws 48 installed at two ends of the elastic plate 44 for adjusting the position of the elastic arms 46. When the screws 48 are adjusted downward, the revolving axle 40 of the second roller 38 moves downward inside the vertical slots 50 so that the second roller 38 is brought in close contact with the first roller 36.

Compared to the prior art paper feeding module 10, the paper feeding module 32 utilizes the elastic arms 46 installed at both sides of each sleeve 42 to depress the revolving axle 40 so that each sleeve 42 of the second roller 38 evenly and tightly clamps the paper with the first roller 36. The paper feeding module 32 drives the paper without bending of the revolving axle 40 of the second roller 38 and no paper displacement occurs.

Those skilled in the art will readily observe that numerous modifications and alterations of the device may be made while retaining the teachings of the invention.

Accordingly, the above disclosure should be construed as limited only by the metes and bounds of the appended claims.

What is claimed is:

1. A paper feeding module of a color picture printer for driving a paper back and forth through a printing module of the printer for printing, the printer comprising a housing, the printing module being installed inside the housing for printing the paper, the paper feeding module comprising:

a first roller horizontally oriented and rotatably installed inside the housing;

a second roller having a revolving axle and at least two cylindrical sleeves fixed on the revolving axle for clamping the paper with the first roller wherein the second roller is moveable in a vertical direction above the first roller inside the housing, and is rotatably in contact with the first roller when printing; and an elastic device installed between the second roller and the housing comprising a plurality of elastic arms, each having a free end in contact with two ends of the revolving axle of the second roller and the portion of the revolving axle between each adjacent pair of sleeves for uniformly depressing the revolving axle of the second roller so that each sleeve of the second roller is in even and tight contact with the first roller so as to clamp the paper.

2. The paper feeding module of claim 1 wherein the elastic device comprises a curved elastic plate with the elastic arms installed in one end of the elastic plate for evenly pushing the second roller against the first roller.

3. The paper feeding module of claim 2 wherein two elastic arms of the elastic plate are separately positioned at two ends of each sleeve of the second roller for evenly pushing the sleeve of the second roller against the first roller.

4. The paper feeding module of claim 2 wherein the elastic device further comprises two adjustable screws installed at two ends of the elastic plate for adjusting the elastic force of the elastic plate exerted to the second roller so as to enable the arms of the elastic plate to evenly push the second roller against the first roller.

5. The paper feeding module of claim 1 wherein the housing further comprises two vertical slots installed above two ends of the first roller wherein two ends of the revolving axle of the second roller are moveably installed inside the two vertical slots and are vertically movable along the two vertical slots.

* * * * *